US009359561B2

(12) United States Patent
Bazer-Bachi et al.

(10) Patent No.: US 9,359,561 B2
(45) Date of Patent: Jun. 7, 2016

(54) PROCESS FOR HYDROTREATING HEAVY HYDROCARBON FEEDS WITH SWITCHABLE REACTORS INCLUDING AT LEAST ONE STEP OF PROGRESSIVE SWITCHING

(75) Inventors: Frederic Bazer-Bachi, Saint Genis-Laval (FR); Mathieu Digne, Lyons (FR); Jan Verstraete, Lyons (FR); Nicolas Marchal, Le Chesnay (FR); Cecile Plain, Saint Germain en Laye (FR)

(73) Assignee: IFP ENERGIES NOUVELLES, Rueil-Malmaison (FR)

( * ) Notice: Subject to any disclaimer, the term of this patent is extended or adjusted under 35 U.S.C. 154(b) by 441 days.

(21) Appl. No.: 13/979,038

(22) PCT Filed: Dec. 20, 2011

(86) PCT No.: PCT/FR2011/000667

§ 371 (c)(1),
(2), (4) Date: Oct. 17, 2013

(87) PCT Pub. No.: WO2012/095565

PCT Pub. Date: Jul. 19, 2012

(65) Prior Publication Data

US 2014/0027351 A1 Jan. 30, 2014

(30) Foreign Application Priority Data

Jan. 10, 2011 (FR) ..... 10 00.075

(51) Int. Cl.

| | |
|---|---|
| ***C10G 65/04*** | (2006.01) |
| ***C10G 45/72*** | (2006.01) |
| ***C10G 45/02*** | (2006.01) |
| ***C10G 45/04*** | (2006.01) |
| ***C10G 65/00*** | (2006.01) |

(52) U.S. Cl.

CPC ..... *C10G 45/04* (2013.01); *C10G 65/00* (2013.01); *C10G 65/04* (2013.01); *C10G 2300/202* (2013.01); *C10G 2300/205* (2013.01); *C10G 2300/206* (2013.01); *C10G 2300/208* (2013.01)

(58) Field of Classification Search

CPC ..... C10G 2300/202; C10G 2300/205; C10G 2300/206; C10G 2300/208; C10G 45/04; C10G 65/00; C10G 65/04

See application file for complete search history.

(56) References Cited

U.S. PATENT DOCUMENTS

2009/0139902 A1* 6/2009 Kressmann ..... C10G 45/02 208/218

FOREIGN PATENT DOCUMENTS

FR 2 681 871 4/1993

OTHER PUBLICATIONS

Search Report for FR1100075 dated Aug. 31, 2011.

(Continued)

*Primary Examiner* — In Suk Bullock
*Assistant Examiner* — Derek Mueller
(74) *Attorney, Agent, or Firm* — Miller, White, Zelano, Branigan, P.C.

(57) ABSTRACT

Process for hydrotreating a heavy hydrocarbon fraction using a system of switchable fixed bed guard zones each containing at least one catalyst bed including at least one step during which the flow of feed supplied to the first guard zone brought into contact with the feed is partly displaced to the next guard zone downstream, preferably progressively.

13 Claims, 3 Drawing Sheets

(56) References Cited

OTHER PUBLICATIONS

Inst Francais Du Petrole, "Heavy hydrocarbon fraction hydrotreatment, for asphaltene and impurity removal—by hydro-demetallising charge with caralyst and fixed bed zone(s) in series with protective zones for recycling, and hydrodesulphurising," Espacenet, Publication Date: Apr. 2, 1993; English Abstract of FR-2 681 871.

* cited by examiner

PROCESS FOR HYDROTREATING HEAVY HYDROCARBON FEEDS WITH SWITCHABLE REACTORS INCLUDING AT LEAST ONE STEP OF PROGRESSIVE SWITCHING

The present invention relates to a process for hydrotreating a heavy hydrocarbon fraction using a system of switchable fixed bed guard zones each containing at least one catalyst bed including at least one step during which the flow of feed supplied to the first guard zone brought into contact with the feed is partly displaced to the next guard zone downstream, preferably progressively.

Hydrotreating of hydrocarbon feeds is becoming increasingly important in refining practice with the increasing need to reduce the quantity of sulphur in petroleum cuts and to convert heavy fractions to lighter fractions, which can be upgraded as fuels and/or chemical products. It is in fact necessary, in view of the standard specifications imposed by each country for commercial fuels, for imported crudes, which have higher and higher contents of heavy fractions, of heteroatoms and of metals, and lower and lower hydrogen contents, to be upgraded as far as possible.

Catalytic hydrotreating makes it possible, by bringing a hydrocarbon feed into contact with a catalyst in the presence of hydrogen, to reduce its content of asphaltenes, metals, sulphur and other impurities considerably, while improving the ratio of hydrogen to carbon (H/C) and while transforming it more or less partially into lighter cuts. Thus, hydrotreating (HDT) in particular means reactions of hydrodesulphurization (HDS) by which are meant the reactions for removing sulphur from the feed with production of $H_2S$, reactions of hydrodenitrogenation (HDN) by which are meant the reactions for removing nitrogen from the feed with production of $NH_3$, and reactions of hydrodemetallization by which are meant the reactions for removing metals from the feed by precipitation, but also hydrogenation, hydrodeoxygenation, hydrodearomatization, hydroisomerization, hydrodealkylation and hydrodeasphalting.

There are two types of hydrotreating process for treating heavy feeds such as atmospheric residues (AR) or vacuum residues (VR): fixed bed processes and ebullating bed processes. Zong et al. (Recent Patents on Chemical Engineering, 2009, 2, 22-36) summarize the various processes known in the treatment of heavy petroleum feeds.

The technology of the fixed bed processes has found the widest industrial application owing to its technical maturity, lower cost and stable and reliable performance. In these processes, the feed circulates through several fixed bed reactors arranged in series, the first reactor(s) being used in particular for performing hydrodemetallization of the feed (so-called HDM step) as well as a proportion of hydrodesulphurization, the last reactor(s) being used for performing deep refining of the feed (hydrotreating step, HDT), and in particular hydrodesulphurization (so-called HDS step). The effluents are withdrawn from the last HDT reactor.

The fixed bed processes lead to high performance in refining (production of 370° C.$^+$ cuts with less than 0.5 wt. % of sulphur and containing less than 20 ppm of metals) from feed containing up to 5 wt. % of sulphur and up to 300 ppm of metals, in particular nickel and vanadium). The various effluents thus obtained can serve as a basis for the production of heavy fuel oils of good quality, of gas oil and gasoline, or feeds for other units such as catalytic cracking.

Beyond this content of metals, it is known that the first catalyst beds can quickly be deactivated because of the considerable deposit of metals that is produced. To compensate for this deactivation, the temperature of the reactor is then increased. However, this increase in temperature promotes the deposition of coke, accelerating the processes of intragranular clogging (plugging of the catalyst pores) and extragranular clogging (plugging of the catalyst bed). Beyond these contents of metals in the feed, ebullating bed processes are thus generally preferred. In fact, one problem posed by fixed bed catalytic hydrotreating of these feeds arises because during the hydrotreating reactions of petroleum fractions containing organometallic complexes, most of these complexes are destroyed in the presence of hydrogen, hydrogen sulphide, and a hydrotreating catalyst. The metal constituent of these complexes then precipitates in the form of a solid sulphide, which will adhere to the catalyst. This is particularly so with complexes of vanadium, nickel, iron, sodium, titanium, silicon and copper, which are naturally present in crude oils at a varying level depending on the origin of the petroleum, and which, during the operations of distillation, tend to become concentrated in high boiling point fractions and in particular in residues. In addition to these impurities, coke is also deposited, and together they then tend to deactivate and clog the catalytic system very quickly. These phenomena lead to stoppage of the hydrotreating units for replacing the solids and to an overconsumption of catalyst, which a person skilled in the art wishes to minimize.

Another problem posed by fixed bed catalytic hydrotreating of these feeds is clogging. It is known that catalyst beds, in particular the upper portions of catalyst beds, and more particularly the upper portions of the first catalyst bed in contact with the feed, are likely to clog quite quickly because of the asphaltenes and sediments contained in the feed, which is manifested firstly by an increase in head loss and sooner or later requires a stoppage of the unit for replacing the catalyst.

Therefore it becomes necessary to stop the unit in order to replace the first catalyst beds, which are deactivated and/or clogged. The hydrotreating processes for feeds of this type must therefore be designed so as to permit an operating cycle that is as long as possible without stopping the unit.

STATE OF THE ART

There have been attempts to resolve these drawbacks of the fixed bed arrangements in various ways, in particular by using guard beds installed upstream of the main reactors. The main task of the guard beds is to protect the catalysts of the main hydrotreating reactors downstream, by performing a proportion of the demetallization and by filtering the particles contained in the feed that can lead to clogging. The guard beds are generally integrated in the HDM section in a process for hydrotreating heavy feeds generally including a first HDM section and then a second HDT section. Although the guard beds are generally used for performing a first hydrodemetallization and a filtration, other hydrotreating reactions (HDS, HDN, etc.) will inevitably take place in these reactors owing to the presence of hydrogen and a catalyst.

Thus, installation of one or more moving-bed reactors at the head of the HDM step has been considered (U.S. Pat. No. 3,910,834 or GB2124252). The operation of these moving beds can be co-current (SHELL's HYCON process for example) or counter-current (OCR process of Chevron Lummus Global and the applicant's HYVAHL-M™ process for example). Adding a fixed bed guard reactor in front of the HDM reactors has also been considered (U.S. Pat. No. 4,118,310 and U.S. Pat. No. 3,968,026). Most often this guard reactor can be by-passed in particular by using an isolating valve. This provides temporary protection of the main reactors against clogging.

Moreover, a system has also been described, in particular by the applicant (FR2681871 and U.S. Pat. No. 5,417,846), for combining the high performance of the fixed bed with a high operating factor for treating feeds with high contents of metals, which consists of a hydrotreating process in at least two steps for a heavy hydrocarbon fraction containing asphaltenes, sulphur-containing impurities and metallic impurities, in which, during the first so-called HDM step, the feed of hydrocarbons and hydrogen is passed, under conditions of HDM, over an HDM catalyst, then, during the next, second step, the effluent from the first step is passed, under conditions of HDT, over an HDT catalyst. The HDM step comprises one or more fixed bed HDM zones preceded by at least two guard HDM zones, also called "switchable reactors", also of fixed bed design, arranged in series to be used cyclically, consisting of successive repetition of steps b) and c) defined below:

a) a step in which the guard zones are all used together for a period at most equal to the deactivation time and/or clogging time of one of them, b) a step during which the deactivated and/or clogged guard zone is by-passed and the catalyst that it contains is regenerated and/or replaced with fresh catalyst and during which the other guard zone(s) are used, c) a step during which the guard zones are all used together, the guard zone of which the catalyst was regenerated during the preceding step being reconnected and said step being continued for a period at most equal to the deactivation time and/or clogging time of one of the guard zones.

This process, known by the name HYVAHL-F™, can provide an overall desulphurization greater than 90% and an overall demetallization of the order of 95%. The use of switchable reactors permits continuous cyclic operation.

It has now been discovered, surprisingly, that it is possible to increase the time of use of the switchable reactors before replacement of the catalyst contained in the switchable reactors becomes necessary. The present invention thus improves the performance of switchable reactors as described by the applicant in patent FR2681871, by incorporating, after the steps during which the feed passes successively through all the guard zones, additional steps, in which the flow of feed supplied to the first guard zone brought into contact with the feed is partly displaced to the next guard zone, preferably progressively. Thus, during these additional steps, the feed is introduced onto two adjacent guard zones simultaneously. This flow displacement makes it possible to delay the increase in head loss of the first guard zone brought into contact with the feed and thus prolongs its working life. The introduction of a portion of the feed onto a next zone downstream while another portion of the feed continues to pass through the first zone brought into contact with the feed makes it possible to by-pass and therefore "relieve" the first guard zone. The portion of the feed introduced into the next zone downstream thus passes through a zone that is much less clogged and/or deactivated than the first zone.

Moreover, several operational factors concerning the manner of implementing this displacement, in particular the start time of the displacement step, the quantity of feed introduced onto the next zone at the start of the displacement step and its subsequent progression of introduction, make it possible to optimize the operating time of each guard zone and therefore lengthen the overall cycle of the switchable reactors.

This lengthening of the cycle leads to an increase in the operating factor of the unit as well as a saving of time, a reduction of operating costs and a reduction of the consumption of fresh catalyst. The aim of the present invention is thus to increase the cycle time of the guard zones.

DETAILED DESCRIPTION

Figure 1:
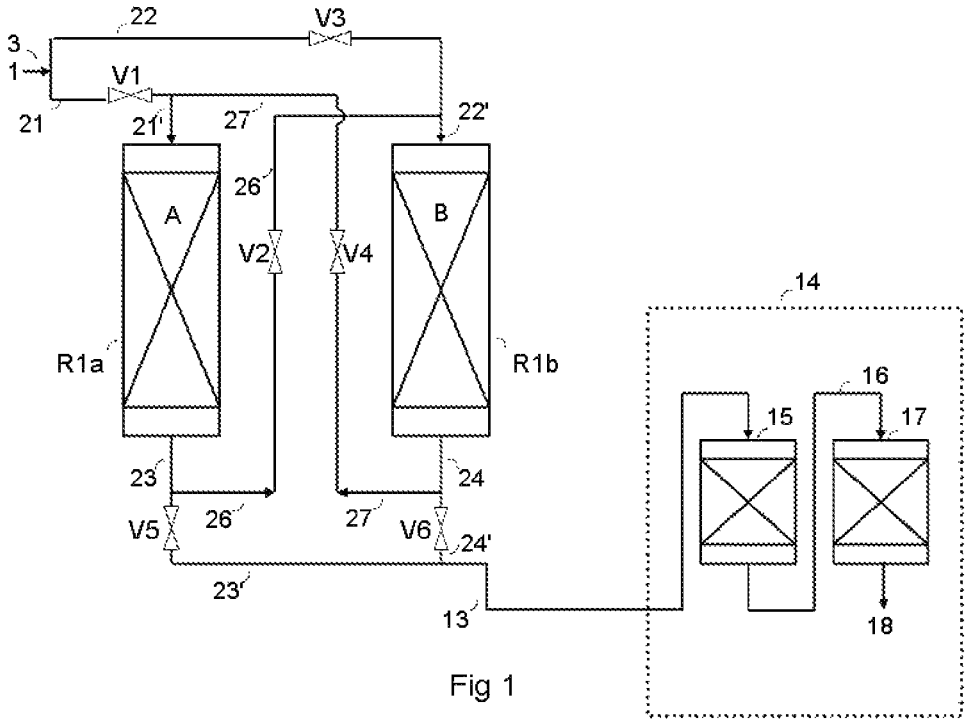
FIG. 1 illustrates an embodiment of the process according to the invention using a system of two switchable guard zones.

The present invention provides an improvement of the hydrotreating process carried out using guard zones (switchable reactors) as described in patent FR2681871. The operation of the guard zones according to FR2681871 is described in FIG. 1, comprising two guard zones (or switchable reactors) R1*a* and R1*b*. This process comprises a series of cycles each comprising four successive steps:

- a first step (called "step a" hereinafter) during which the feed passes successively through reactor R1*a*, then reactor R1*b*,
- a second step (called "step b" hereinafter) during which the feed only passes through reactor R1*b*, reactor R1*a* being by-passed for catalyst regeneration and/or replacement,
- a third step (called "step c" hereinafter) during which the feed passes successively through reactor R1*b*, then reactor R1*a*,
- a fourth step (called "step d" hereinafter) during which the feed only passes through reactor R1*a*, reactor R1*b* being by-passed for catalyst regeneration and/or replacement.

During step a) of the process, the feed is introduced via line 3 and line 21, having an open valve V1, into line 21' and the guard reactor R1*a* containing a fixed catalyst bed A. During this period, valves V3, V4 and V5 are closed. The effluent from reactor R1*a* is sent via pipe 23, pipe 26, having an open valve V2, and pipe 22' into the guard reactor R1*b* containing a fixed catalyst bed B. The effluent from reactor R1*b* is sent via pipes 24 and 24', having an open valve V6, and pipe 13 to the main hydrotreating section 14. During step b) of the process, valves V1, V2, V4 and V5 are closed and the feed is introduced via line 3 and line 22, having an open valve V3, into line 22' and reactor R1*b*. During this period the effluent from reactor R1*b* is sent via pipes 24 and 24', having an open valve V6, and pipe 13 to the main hydrotreating section 14.

During step c), valves V1, V2 and V6 are closed and valves V3, V4 and V5 are open. The feed is introduced via line 3 and lines 22 and 22' into reactor R1*b*. The effluent from reactor R1*b* is sent via pipe 24, pipe 27, having an open valve V4, and pipe 21' to the guard reactor R1*a*. The effluent from reactor R1*a* is sent via pipes 23 and 23', having an open valve V5, and pipe 13 to the main hydrotreating section 14.

During step d), valves V2, V3, V4 and V6 are closed and valves V1 and V5 are open. The feed is introduced via line 3 and lines 21 and 21' into reactor R1*a*. During this period the effluent from reactor R1*a* is sent via pipes 23 and 23', having an open valve V5, and pipe 13 to the main hydrotreating section 14.

The cycle then begins again. The operations on the valves of the unit enabling the functioning of the switchable reactors according to FR2681871 are presented in Table 1.

TABLE 1

Operations on the valves around the switchable reactors according to FR2681871

| | Step in Cycle | Intervention | V1 | V2 | V3 | V4 | V5 | V6 |
|---|---|---|---|---|---|---|---|---|
| a | R1A + R1B | — | O* | O | C** | C | C | O |
| b | R1B | R1A | C | C | O | C | C | O |
| c | R1B + R1A | — | C | C | O | O | O | C |
| d | R1A | R1B | O | C | C | C | O | C |
| a | R1A + R1B | — | O | O | C | C | C | O |

*O = open,
**C = closed

The present invention improves the operation of the guard zones described in the state of the art by integrating into this process, after the steps during which the feed passes successively through all the guard zones, additional steps, in which the flow of feed supplied to the first guard zone brought into contact with the feed is partly displaced to the next guard zone downstream, preferably progressively.

More particularly, the present invention relates to a process for hydrotreating a heavy hydrocarbon fraction containing asphaltenes, sediments, sulphur-containing, nitrogen-containing and metallic impurities, in which the feed of hydrocarbons and hydrogen is passed, under conditions of hydrotreating, over a hydrotreating catalyst, in at least two fixed bed hydrotreating guard zones each containing at least one catalyst bed, the guard zones being arranged in series to be used cyclically, consisting of successive repetition of steps b), c) and c') defined below:

- a step a) during which the feed passes through all the guard zones during a fraction of the deactivation time and/or clogging time of the first guard zone brought into contact with the feed,
- a step a') during which a portion of the feed continues to pass through the first guard zone brought into contact with the feed and another portion of the feed is introduced into the next guard zone downstream for a period at most equal to the deactivation time and/or clogging time of the first guard zone brought into contact with the feed,
- a step b) during which the deactivated and/or clogged guard zone is by-passed and the catalyst that it contains is regenerated and/or replaced with fresh catalyst and during which the other guard zone(s) are used,
- a step c) during which the feed passes through all the guard zones, the guard zone of which the catalyst was regenerated during the preceding step being reconnected so as to be downstream of all the other guard zones and said step being continued for a fraction of the deactivation time and/or clogging time of the first guard zone brought into contact with the feed,
- a step c') during which a portion of the feed continues to pass through the first guard zone brought into contact with the feed and another portion of the feed is introduced into the next guard zone downstream for a period at most equal to the deactivation time and/or clogging time of the first guard zone brought into contact with the feed.

The guard zones, in particular the first guard zone brought into contact with the feed, gradually become laden with metals, coke, sediments and various other impurities. When the catalyst or catalysts that they contain is/are practically saturated with metals and various impurities, the zones must be disconnected for carrying out replacement or regeneration of the catalyst(s). Preferably, the catalysts are replaced. This moment is called the deactivation time and/or clogging time.

Although the deactivation time and/or clogging time varies in relation to the feed, the operating conditions and the catalyst(s) used, it is generally manifested by a drop in catalyst performance (an increase in the concentration of metals and/or other impurities in the effluent), an increase in the temperature required for maintaining constant hydrotreating or, in the specific case of clogging, by a significant increase in head loss. The head loss Δp, expressing a degree of clogging, is measured continuously throughout the cycle on each of the zones and can be defined by an increase in pressure resulting from partially blocked passage through the zone. The temperature is also measured continuously throughout the cycle on each of the two zones.

In order to define a deactivation time and/or clogging time, a person skilled in the art first defines a maximum tolerable value of the head loss Δp and/or of the temperature as a function of the feed to be treated, the operating conditions and catalysts selected, and starting from which it is necessary to proceed to disconnection of the guard zone. The deactivation time and/or clogging time is thus defined as the time when the limit value of head loss and/or of temperature is reached. As a general rule the limit value of head loss and/or of temperature is confirmed during initial commissioning of the reactors. In the case of a process for hydrotreating heavy fractions, the limit value of head loss is generally between 0.3 and 1 MPa (3 and 10 bar), preferably between 0.5 and 0.8 MPa (5 and 8 bar). The limit value of temperature is generally between 400° C. and 430° C., the temperature corresponding, here and hereinafter, to the average measured temperature of the catalyst bed. Another limit value for the temperatures, indicating that deactivation is reached (lower level of exothermic reactions), is that the temperature difference (ΔT) on a catalyst bed becomes less than 5° C., regardless of the average temperature value.

According to the present invention, the flow of feed supplied to the first guard zone brought into contact with the feed is partly displaced to the next guard zone downstream before the deactivation time and/or clogging time.

The process according to the invention is described with the aid of FIG. 1 using a system of two switchable guard zones. This process comprises a series of cycles each having six successive steps:

- a step a) during which the feed passes successively through the guard zones R1*a* and R1*b* during a fraction of the deactivation time and/or clogging time of zone R1*a*,
- a step a') (displacement step) during which a portion of the feed continues to pass through zone R1*a* and another portion of the feed is introduced into zone R1*b* for a period at most equal to the deactivation time and/or clogging time of zone R1*a*,
- a step b) during which the feed passes through reactor R1*b* only, reactor R1*a* being by-passed for catalyst regeneration and/or replacement,
- a step c) during which the feed passes successively through zones R1*b* and R1*a* during a fraction of the deactivation time and/or clogging time of R1*b*,
- a step c') (displacement step) during which a portion of the feed continues to pass through zone R1*b* and another portion of the feed is introduced into zone R1*a* for a period at most equal to the deactivation time and/or clogging time of zone R1*b*,
- a step d) during which the feed passes through reactor R1*a* only, reactor R1*b* being by-passed for catalyst regeneration and/or replacement.

During step a) of the process, the feed is introduced via line 3 and lines 21 and 21', having an open valve V1, into the guard reactor R1*a* containing a fixed catalyst bed A. During this period valves V3, V4 and V5 are closed. The effluent from reactor R1*a* is sent via pipe 23, pipe 26, having an open valve V2, and pipe 22' into the guard reactor R1*b* containing a fixed catalyst bed B. The effluent from reactor R1*b* is sent via pipes 24 and 24', having an open valve V6, and pipe 13 to the main hydrotreating section 14.

Gradually, the guard zones, and in particular the first guard zone brought into contact with the feed (R1*a*) will become clogged and/or deactivated. An increase in head loss and/or a loss of catalyst efficiency, making it necessary to increase the temperature, is then observed. Step a') is then carried out, during which a portion of the feed continues to pass through zone R1*a* and another portion of the feed is introduced into zone R1*b*. Thus, a portion of the feed is introduced via line 3 and lines 21 and 21', having an open valve V1 (also called main valve), into the guard reactor R1*a* and another portion of the feed is introduced via line 3 and lines 22 and 22', having an open valve V3 (also called displacement valve), into the guard zone R1*b*. During this period valves V4 and V5 are closed. The effluent from reactor R1*a* is sent via pipe 23, pipe 26, having an open valve V2, and pipe 22' into the guard reactor R1*b*, thus rejoining the other portion of the feed introduced directly. The effluent from reactor R1*b* is sent via pipes 24 and 24', having an open valve V6, and pipe 13 to the main hydrotreating section 14. Step a') continues until the limit value of head loss and/or of temperature is reached for zone R1*a*.

Step b) is then carried out, during which the feed passes through reactor R1*b* only, reactor R1*a* being by-passed for catalyst regeneration and/or replacement. Thus, according to FIG. 1, valves V1, V2, V4 and V5 are closed and the feed is introduced via line 3 and lines 22 and 22', having an open valve V3, into reactor R1*b*. During this period the effluent from reactor R1*b* is sent via pipes 24 and 24', having an open valve V6, and pipe 13 to the main hydrotreating section 14.

After reconnection of reactor R1*a*, of which the catalyst was regenerated or replaced, downstream of reactor R1*b*, step c) of the process is then carried out, during which the feed passes successively through reactor R1*b*, then reactor R1*a*. During this step c), valves V1, V2 and V6 are closed and valves V3, V4 and V5 are open. The feed is introduced via line 3 and lines 22 and 22' into reactor R1*b*. The effluent from reactor R1*b* is sent via pipe 24, pipe 27, having an open valve V4, and pipe 21' into the guard reactor R1*a*. The effluent from reactor R1*a* is sent via pipes 23 and 23', having an open valve V5, and pipe 13 to the main hydrotreating section 14.

Gradually, the guard zones, and in particular the first guard zone brought into contact with the feed (R1*b*) will become clogged and/or deactivated. In the same way as in step a') a partial displacement of the feed to the next guard zone downstream, called step c'), is then carried out. Thus, according to FIG. 1, valve V1 of zone R1*a* is also opened. Thus, a portion of the feed is introduced via line 3 and lines 22 and 22', having an open valve V3 (also called main valve), into the guard reactor R1*b* and another portion of the feed is introduced via line 3 and lines 21 and 21', having an open valve V1 (also called displacement valve), into the guard zone R1*a*. During this period valves V2 and V6 are closed. The effluent from reactor R1*b* is sent via pipe 24, pipe 27, having an open valve V4, and pipe 21' into the guard reactor R1*a*, thus rejoining the other portion of the feed introduced directly. The effluent from reactor R1*a* is sent via pipes 23 and 23', having an open valve V5, and pipe 13 to the main hydrotreating section 14. Step c') continues until the limit value of head loss and/or of temperature is reached for zone R1*b*.

Step d) is then carried out, during which the feed passes through reactor R1*a* only, reactor R1*b* being by-passed for catalyst regeneration and/or replacement. Thus, according to FIG. 1, valves V2, V3, V4 and V6 are closed and valves V1 and V5 are open. The feed is introduced via line 3 and lines 21 and 21' into reactor R1*a*. During this period the effluent from reactor R1*a* is sent via pipes 23 and 23', having an open valve V5, and pipe 13 to the main hydrotreating section 14.

The cycle then begins again. The operations on the valves of the unit permitting functioning of the switchable reactors according to the invention are shown in Table 2.

TABLE 2

Operations on the valves for the system of switchable reactors according to the invention

| Step in Cycle | | Intervention | V1 | V2 | V3 | V4 | V5 | V6 |
|---|---|---|---|---|---|---|---|---|
| a | R1A + R1B | — | O* | O | C** | C | C | O |
| a' | R1A + R1B | — | O | O | O | C | C | O |
| b | R1B | R1A | C | C | O | C | C | O |
| c | R1B + R1A | — | C | C | O | O | O | C |
| c' | R1B + R1A | — | O | C | O | O | O | C |
| d | R1A | R1B | O | C | C | C | O | C |
| a | R1A + R1B | — | O | O | C | C | C | O |

*O = open,
**C = closed

Preferably, the portion of the feed introduced into the next guard zone downstream during steps a') and c') does not exceed 50% of the total feed. The maximum value of opening of the valve feeding the next zone downstream (displacement valve) is then 50%. In fact, when more than 50% of the feed is introduced into the next zone downstream (and therefore less than 50% is introduced into the first zone brought into contact with the feed), there is a risk of the two zones becoming clogged and/or deactivated at the same time, simultaneously reaching the maximum value of head loss and/or of temperature. This can lead to malfunctioning of the switching cycle. In fact, to ensure proper continuous operation of the two reactors, there must be sufficient time for the step of catalyst regeneration and/or replacement (step b) and d)) of one reactor before the other reactor reaches the limit value of head loss and/or of temperature necessitating replacement of its catalyst.

Several operating parameters permit optimization of the operating time of each guard zone, in particular by optimizing the manner of simultaneous introduction of the feed into two adjacent guard zones during steps a') and c'). These parameters relate to:

- the start time of the displacement step,
- the quantity of feed introduced onto the next guard zone downstream at the start of the displacement step (initial opening of the displacement valve)
- the gradual increase in the quantity of feed introduced onto the next zone downstream during the displacement step (progressive opening of the displacement valve).

The moment of displacement corresponds to the moment when the introduction of a portion of the feed onto the next zone downstream is started, while continuing to feed the first zone brought into contact with the feed. This time is preferably between 30 and 95%, and more preferably between 60 and 90% of the deactivation time and/or clogging time of the first guard zone brought into contact with the feed. In fact, the cycle time increases more as the moment of displacement is delayed, i.e. at a time when the zone in the first position is already well filled with clogging substances.

Another parameter permitting optimization of the operating time is the quantity of feed introduced into the next zone downstream at the start of displacement steps a') and c'). The displacement valves (V3 in step a') and V1 in step c')) make it possible to control the quantity of feed introduced onto the next zone downstream. The quantity of feed still being introduced into the first zone brought into contact with the feed is reduced even more (by controlling the main valves V1 of step a') and V3 of step c'). The portion of the feed introduced into the next zone downstream at the start of steps a') and c') is between 0 and 50%, preferably between 20 and 40% of the total feed, expressed in vol. %. The minimum value of 0% of introduction of feed at the start of a step requires an increase in the quantity of feed introduced subsequently. Preferably, introduction of more than 50% of the feed onto the next zone downstream will be avoided for reasons of risk of simultaneous clogging of the two zones mentioned above.

Another important parameter permitting optimization of the operating time is the increase in the quantity of feed introduced onto the next zone downstream during steps a') and c'). Preferably, said portion of the feed introduced into the next guard zone downstream increases progressively during steps a') and c'), which is manifested by progressive opening of the displacement valve at the same time as progressive closing of the main valve by the same amount. The progressive increase can take place continuously or in stages. The increase in the quantity of feed introduced into the next zone downstream can be defined by a percentage increase per % of deactivation time and/or clogging time of the first zone brought into contact with the feed. Preferably, it is between 0.02 and 4%, preferably between 0.02 and 1% per % of deactivation time and/or clogging time. Preferably, an increase leading to introduction of more than 50% of the feed onto the next zone downstream will be avoided for reasons of risk of simultaneous clogging of the two zones mentioned above.

In a preferred embodiment, a catalyst conditioning section is used, allowing these guard zones to be switched while in operation, i.e. without stopping the operation of the unit: first, a system that operates at moderate pressure (from 10 to 50 bar, but preferably from 15 to 25 bar) allows the following operations to be performed on the disconnected guard reactor: washing, stripping, cooling, before discharging the used catalyst; then heating and sulphurization after loading the fresh catalyst; then another system for pressurization/depressurization, with gate valves of appropriate design, permits efficient switching of these guard zones without stopping the unit, i.e. without affecting the operating factor, since all the operations of washing, stripping, discharge of the used catalyst, loading of the fresh catalyst, heating, and sulphurization are carried out on the disconnected reactor or guard zone. Alternatively, a pre-activity catalyst can be used in the conditioning section so as to simplify the procedure for switching while in operation.

Each guard zone contains at least one catalyst bed (for example 1, 2, 3, 4, or 5 catalyst beds). Preferably, each guard zone contains one catalyst bed. Each catalyst bed contains at least one catalyst layer containing one or more catalysts, optionally supplemented with at least one inert layer. The catalysts used in the catalyst bed(s) can be identical or different.

The hydrotreating process using switchable reactors can thus greatly increase the duration of a cycle. During steps a') and c') a portion of the feed has a shortened residence time in the switchable reactors because of by-passing the first zone. In order to maintain the constant degree of hydrotreating at the outlet of the last reactor, the temperature in the zones is thus gradually increased. The latter is also increased overall during the cycle to counteract catalyst deactivation. However, this temperature increase promotes the deposition of coke, accelerating the processes of clogging. Thus, to limit an excessive temperature rise, the fraction introduced into the next guard zone during steps a') and c') must be restricted. The quantity of the feed introduced into the next zone downstream is thus based on optimization between the gain in cycle time and limited temperature rise.

According to a preferred variant, at the entrance of each guard zone the feed passes through a filtering distributor plate composed of a single stage or of two successive stages, said plate is situated upstream of the catalyst bed(s). This filtering plate, described in patent US2009177023, makes it possible to trap the clogging particles contained in the feed by means of a special distributor plate comprising a filtering medium. Thus, the filtering plate makes it possible to increase the gain of time in the hydrotreating process using switchable guard zones. This filtering plate simultaneously provides distribution of the gas phase (hydrogen and the gaseous portion of the feed) and the liquid phase (the liquid portion of the feed) feeding the reactor while providing a filtration function with respect to the impurities contained in the feed. Moreover, the filtering plate ensures a more uniform distribution of the mixture over the whole surface of the catalyst bed and limits the problems of poor distribution during the phase of clogging of the plate itself.

More precisely, the filtering plate is a device for filtration and distribution, said device comprising a plate situated upstream of the catalyst bed, said plate consisting of a base that is approximately horizontal and integral with the walls of the reactor and to which approximately vertical chimneys are fixed, open at the top for admission of the gas, and at the bottom for removing the gas-liquid mixture intended to feed the catalyst bed situated downstream, said chimneys being pierced over a certain fraction of their height by a continuous lateral slit or by lateral orifices for admission of liquid, said plate supporting a filtering bed surrounding the chimneys, and said filtering bed consisting of at least one layer of particles of size less than or equal to the size of the particles of the catalyst bed. The filtering bed consists of particles that are generally inert but can also comprise at least one layer of catalyst identical to or belonging to the same family as the catalyst of the catalyst bed. This last-mentioned variant makes it possible to reduce the volume of catalyst beds in the reactor.

The filtering distributor plate can also comprise two stages and be composed of two successive plates: the first plate supporting a guard bed composed of internal particles and of at least one layer of catalyst identical to or belonging to the same family as the catalyst of the catalyst bed. This plate is described in patent US2009177023. The bed is arranged on a grating, the liquid phase flows through the guard bed and the gas through the chimneys passing through the guard bed and the first plate. At the end of clogging the liquid and the gas flow simultaneously through the chimneys while allowing the second plate to continue to provide its distribution function. The second plate provides the function of distribution of the gas and the liquid: it can be composed of chimneys with lateral perforations for passage of the liquid or be composed of bubble-caps or vapour-lift.

According to another variant, the hydrotreating process according to the present invention can comprise more than two switchable reactors (for example 3, 4 or 5) functioning according to the same principle of switching and of partial flow displacement. In the case shown in FIG. 2, where the guard zone has 3 reactors, the process will comprise, in the preferred embodiment thereof, a series of cycles each having nine successive steps:

a step a) during which the feed passes successively through reactor R1*a*, then reactor R1*b* and finally reactor R1*c*, a step a') (displacement step) during which a portion of the feed continues to pass through reactor R1*a*, then reactor R1*b*, another portion of the feed is introduced directly into reactor R1*b*, then the whole feed passes through reactor R1*c*, a step b) during which the feed passes through reactor R1*b*, then reactor R1*c*, reactor R1*a* being by-passed for catalyst regeneration and/or replacement, a step c) during which the feed passes successively through reactor R1*b*, then reactor R1*c* and finally reactor R1*a*, a step c') (displacement step) during which a portion of the feed continues to pass through reactor R1*b*, then reactor R1*c*, another portion of the feed is introduced directly into reactor R1*c*, then the whole feed passes through reactor R1*a*, a step d) during which the feed passes through reactor R1*c*, then reactor R1*a*, reactor R1*b* being by-passed for catalyst regeneration and/or replacement, a step e) during which the feed passes successively through reactor R1*c*, then reactor R1*a* and finally reactor R1*b*, a step e') (displacement step) during which a portion of the feed continues to pass through reactor R1*c*, then reactor R1*a*, another portion of the feed is introduced directly into reactor R1*a*, then the whole feed passes through reactor R1*b*, a step f) during which the feed passes through reactor R1*a*, then reactor R1*b*, reactor R1*c* being by-passed for catalyst regeneration and/or replacement.

Figure 2:
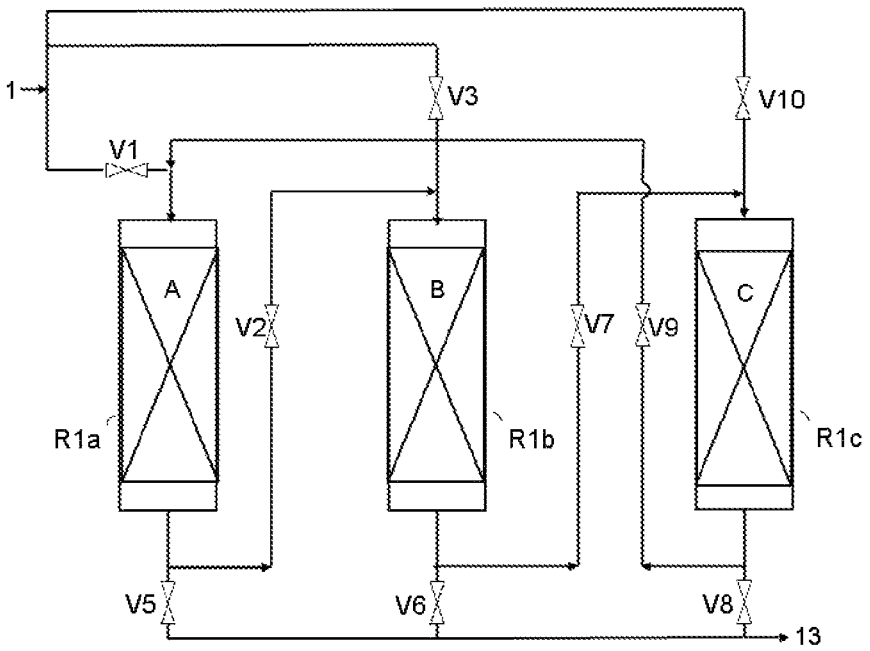
FIG. 2 illustrates an embodiment of the process according to the invention where the guard zone has 3 reactors.

In the case shown schematically in this FIG. 2 the process operates in a manner equivalent to that described in connection with FIG. 1 (the reference symbols for the lines have been omitted for reasons of legibility).

During step a), valves V1, V2, V7 and V8 are open and valves V3, V5, V6, V9 and V10 are closed.

During step a'), valves V1, V2, V3, V7 and V8 are open and valves V5, V6, V9 and V10 are closed.

During step b), valves V3, V7 and V8 are open and valves V1, V2, V5, V6, V9 and V10 are closed.

During step c), valves V3, V7, V9 and V5 are open and valves V1, V2, V6, V8 and V10 are closed.

During step c'), valves V3, V10, V7, V9 and V5 are open and valves V1, V2, V6 and V8 are closed.

During step d), valves V10, V9 and V5 are open and valves V1, V2, V3, V6, V7 and V8 are closed.

During step e), valves V10, V9, V2 and V6 are open and valves V1, V3, V5, V7 and V8 are closed.

During step e'), valves V10, V1, V9, V2 and V6 are open and valves V3, V5, V7 and V8 are closed.

During step f), valves V1, V2 and V6 are open and valves V3, V5, V7, V8, V9 and V10 are closed.

The different variants of the process described above for a system of two switchable reactors also apply to a system having more than two switchable reactors. These different variants are in particular: the conditioning system, the possibility of having more than two catalyst beds per reactor, the moment of displacement, the quantity of feed introduced initially into the next zone downstream and progressive increase thereof with time, maintaining the degree of HDM by raising the temperature and integration of a filtering plate at the entrance of each reactor.

The process according to the invention can advantageously be carried out at a temperature between 320° C. and 430° C., preferably 350° C. to 410° C., at a hydrogen partial pressure advantageously between 3 MPa and 30 MPa, preferably between 10 and 20 MPa, at a space velocity (HSV) advantageously between 0.05 and 5 volumes of feed per volume of catalyst and per hour, and with a ratio of hydrogen gas to liquid hydrocarbon feed advantageously between 200 and 5000 normal cubic meters per cubic meter, preferably 500 to 1500 normal cubic meters per cubic meter. The value of HSV of each switchable reactor in operation is preferably from about 0.5 to 4 $h^{-1}$ and most often from about 1 to 2 $h^{-1}$. The overall value of the HSV of the switchable reactors and that of each reactor is selected so as to achieve maximum HDM while controlling the reaction temperature (limiting the exothermic effect).

The hydrotreating catalysts used are preferably known catalysts and are generally granular catalysts comprising, on a support, at least one metal or metal compound having a hydro-dehydrogenating function. These catalysts are advantageously catalysts comprising at least one group VIII metal, generally selected from the group comprising nickel and/or cobalt, and/or at least one group VIB metal, preferably molybdenum and/or tungsten. The support used is generally selected from the group comprising alumina, silica, silica-aluminas, magnesia, clays and mixtures of at least two of these minerals. Prior to injection of the feed, the catalysts used in the process according to the present invention are preferably subjected to a sulphurization treatment for transforming, at least partly, the metallic species to sulphide before they are brought into contact with the feed to be treated. This treatment of activation by sulphurization is well known to a person skilled in the art and can be carried out by any method already described in the literature, either in situ, i.e. in the reactor, or ex situ.

The feeds treated in the process according to the invention are advantageously selected from atmospheric residues, vacuum residues from direct distillation, crude oils, topped crude oils, deasphalted oils, residues from conversion processes such as for example those originating from coking, from fixed-bed, ebullating-bed, or moving-bed hydroconversion, heavy oils of any origin and in particular those obtained from oil sands or oil shale, used alone or mixed. These feeds can advantageously be used as they are or diluted with a hydrocarbon fraction or a mixture of hydrocarbon fractions that can be selected from the products obtained from a fluid catalytic cracking (FCC) process, a light cut of oil (Light Cycle Oil, LCO), a heavy cut of oil (Heavy Cycle Oil, HCO), a decanted oil (DO), a residue from FCC, or can be obtained from distillation, the gas oil fractions, in particular those obtained by vacuum distillation (Vacuum Gas Oil, VGO). The heavy feeds can also advantageously comprise cuts obtained from the coal liquefaction process, aromatic extracts, or any other hydrocarbon cuts or also non-petroleum feeds such as gaseous and/or liquid derivatives (containing little if any solids) from thermal conversion (with or without catalyst and with or without hydrogen) of coal, biomass or industrial waste, such as for example recycled polymers.

Said heavy feeds generally have more than 1 wt. % of molecules having a boiling point above 500° C., a content of metals Ni+V above 1 ppm by weight, preferably above 20 ppm by weight, a content of asphaltenes, precipitated in heptane, above 0.05 wt. %, preferably, above 1 wt. %.

The hydrotreating process according to the invention makes it possible to effect 50% or more of HDM of the feed at the outlet of the switchable reactors (and more precisely from 50 to 95% of HDM) owing to the HSV selected and the efficiency of the HDM catalyst. The hydrotreating process according to the invention using the system of switchable guard zones including at least one progressive switching step advantageously precedes a fixed bed or ebullating bed process for hydrotreating heavy hydrocarbon feeds. Preferably, it precedes the applicant's Hyvahl-F™ process comprising at least one hydrodemetallization step and at least one hydrodesulphurization step. The process according to the invention is preferably integrated upstream of the HDM section, the switchable reactors being used as guard beds. In the case shown in FIG. 1, the feed 1 enters the switchable guard reactor(s) via pipe 1 and leaves said reactor(s) via pipe 13. The feed leaving the guard reactor(s) enters, via pipe 13, the hydrotreating section 14 and more precisely the HDM section 15 comprising one or more reactors. The effluent from the HDM section 15 is withdrawn via pipe 16, and then sent to the HDT section 17 comprising one or more reactors. The final effluent is withdrawn via pipe 18.

Example 1

Not According to the Invention

The feed consists of a mixture (70/30 wt. %) of atmospheric residue (AR) of Middle East origin (Arabian Medium) and of a vacuum residue (VR) of Middle East origin (Arabian Light). This mixture is characterized by a high viscosity (0.91 cP) at ambient temperature, a density of 994 kg/m$^3$, high contents of Conradson carbon (14 wt. %) and asphaltenes (6 wt. %) and a high level of nickel (22 ppm by weight), vanadium (99 ppm by weight) and sulphur (4.3 wt. %).

The hydrotreating process is carried out according to the process described in FR2681871 and comprises the use of two switchable reactors. The two reactors are loaded with a CoMoNi/alumina hydrodemetallization HDM catalyst. A cycle is defined as integrating the steps from a) to d). The deactivation time and/or clogging time is reached when the head loss reaches 0.7 MPa (7 bar) and/or the average temperature of a bed reaches 405° C. and/or when the temperature difference on a catalyst bed becomes less than 5° C.

The process is carried out at a pressure of 19 MPa, a temperature at the start of the cycle of 360° C. and at the end of the cycle of 400° C., and an HSV=2h$^{-1}$ per reactor, allowing a degree of demetallization close to 60% to be maintained.

Figure 3:
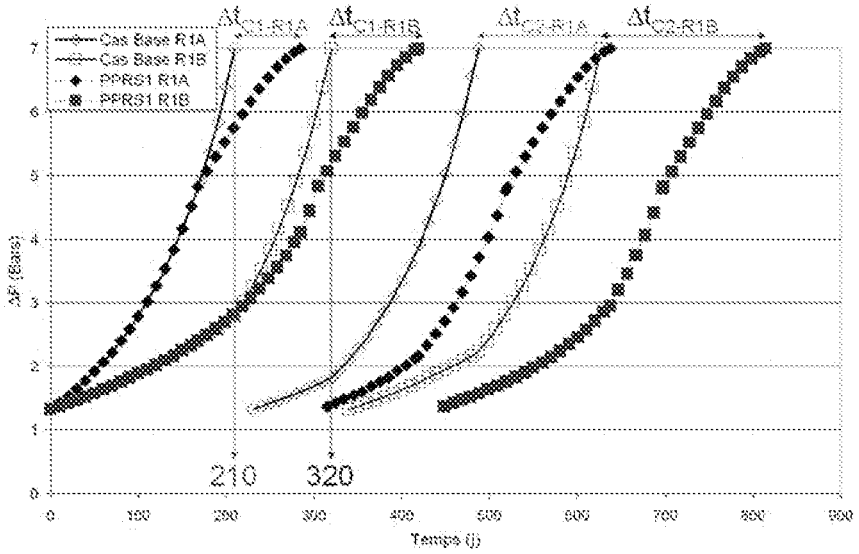
FIG. 3 is a graph showing operating time (in days).

Table 3 and FIG. 3 show the operating time (in days) for the process according to FR 2681871. Thus, according to FIG. 3, the curve of reactor R1*a* according to the state of the art (base case R1*a*) shows, at the start of the cycle, an increase of head loss in the first reactor R1*a* up to its maximum tolerable value (Δp=0.7 MPa or 7 bar) starting from which catalyst replacement is required. In the case of the state of the art (FR268187), the operating time of reactor R1*a* is therefore 210 days. During replacement of the catalyst of reactor R1*a*, the head loss in reactor R1*b* reached about 3 bar. During the next phase in which the feed passes through reactor R1*b* and then reactor R1*a* containing fresh catalyst, the head loss of reactor R1*b* increases up to the maximum tolerable value, which is reached after 320 days of operation. A second cycle can be envisaged for these switchable reactors, by replacing the catalyst of reactor R1*b*.

The deactivation time and/or clogging time (or the operating time) of the first zone is therefore 210 days. Overall, a cycle time of 320 days for the first cycle and of 627 days for two cycles is observed.

Example 2

According to the Invention

The hydrotreating process is repeated with the same feed, the same catalyst and under the same operating conditions as in example 1, except that displacement is carried out according to the invention at 80% of the deactivation time and/or clogging time of the first zone (i.e. at 168 days (80%×210 days)). The percentage of the feed introduced into the second guard zone at the start of step a') or c') is 0% with an increase of 0.7% per % of deactivation time and/or clogging time. The degree of HDM is maintained at 60%.

Table 3 and FIG. 3 show the gain in operating time (in days) for the process according to the invention (example 2) and for the process according to the state of the art (example 1).

TABLE 3

| Gain in operating time (days) | | | | |
|---|---|---|---|---|
| Case | Example 1 (not according to the invention) (days) | Example 2 (according to the invention) (days) | Difference (days) | Difference (%) |
| Duration R1a Cycle 1 | 210 | 285 | 75 | 36 |
| Duration R1b Cycle 1 | 320 | 418 | 98 | 31 |
| Duration R1a Cycle 2 | 487 | 637 | 150 | 31 |
| Duration R1b Cycle 2 | 627 | 814 | 187 | 30 |

FIG. 3 shows the variation of head loss over time measured in zones R1*a* and R1*b* according to the state of the art (FR268187) and according to the invention.

According to the present invention, at 80% of the deactivation time and/or clogging time of R1*a* (i.e. 168 days), a step is added, during which a portion of the feed is introduced into reactor R1*a* and reactor R1*b* simultaneously (case PPRS1 R1*a*). It can then be seen that the head loss increases less quickly (bifurcation of curves R1*a* according to the state of the art and according to the invention), which makes it possible to reach the maximum value of head loss (Δp=0.7 MPa or 7 bar) later and therefore lengthen the operating time of reactor R1*a* to 285 days ($\Delta t_{C1\text{-}R1}a$=75 days)). The head loss of reactor R1*a* then drops abruptly because the system passes to step b) during which the catalyst of reactor R1*a* is regenerated and/or replaced. The feed then passes through reactor R1*b* only, then R1*b* and R1*a* after replacement. Catalyst replacement generally takes 20 days. Curve R1*b* shows the head loss of the second reactor R1*b* as a function of time (base case R1*b* and PPRS1 R1*b* according to the invention). The same phenomenon of gain of time is observed at the end of step c'): $\Delta t_{C1\text{-}R1b}$=98 days. Thus, the operating time of reactor R1*b* is 418 days, which represents a gain of time of about 30% of operating time.

FIG. 3 also shows a second cycle of switchable reactors. The gain of time after 2 successive cycles is then $\Delta t_{C2\text{-}R1a}$=150 days after step a') and $\Delta t_{C2\text{-}R1b}$=187 days after step c'). It can be seen that the more cycles there are, the larger the gain of time, as the time gained in the first cycle is added to that of the second.

It can therefore be seen that the hydrodemetallization process according to the invention makes it possible to increase the cycle time by about 30% while maintaining a degree of HDM of 75%, equivalent to the degree of HDM according to the process of the state of the art.

The invention claimed is:

1. A process for hydrotreating a heavy hydrocarbon fraction containing asphaltenes, sediments, sulphur-containing, nitrogen-containing and metallic impurities, said process comprising:

passing a feed of said heavy hydrocarbon fraction and hydrogen, under hydrotreating conditions, over a hydrotreating catalyst, in at least two fixed bed hydrotreating guard zones, each guard zone containing at least one catalyst bed, said guard zones being arranged in series to be used cyclically, wherein said process comprises:

a) passing the feed through all the guard zones arranged in series during a fraction of the deactivation time and/or clogging time of the first guard zone of the series of guard zones that is brought into contact with the feed, a') continuing to pass a portion of the feed through the first guard zone that is brought into contact with the feed while introducing another portion of the feed into the next guard zone downstream of the first guard zone in the series of guard zones for a period at most equal to the deactivation time and/or clogging time of the first guard zone that is brought into contact with the feed, b) by-passing the first guard zone which is deactivated and/or clogged and regenerating and/or replacing with fresh catalyst the catalyst in the deactivated and/or clogged first guard zone while continuing to pass the feed through the other guard zone(s) in the series of guard zones, c) passing the feed through all the guard zones in the series of guard zones, during which the guard zone in which the catalyst was regenerated during the preceding step is reconnected to the series of guard zones so as to be downstream of all the other guard zones, and continuing to pass the feed through all the guard zones in the series of guard zones for a fraction of the deactivation time and/or clogging time of the first guard zone in the series of guard zones that is brought into contact with the feed, c') continuing to pass a portion of the feed through the first guard zone in the series of guard zones that is brought into contact with the feed while introducing another portion of the feed into the next guard zone downstream of the first guard zone in the series of guard zones for a period at most equal to the deactivation time and/or clogging time of the first guard zone that is brought into contact with the feed, and successively repeating b), c) and c').

2. The process according to claim 1, wherein during a') and c') said portion of the feed introduced into the next guard zone downstream does not exceed 50% of the total feed.

3. The process according to claim 1, wherein during a') and c') said portion of the feed introduced into the next guard zone downstream increases progressively.

4. The process according to claim 3, wherein the progressive increase is carried out continuously or in stages.

5. The process according to claim 3, wherein the increase in the portion of the feed introduced into the next guard zone downstream is from 0.02 to 4% per % of the deactivation time and/or clogging time.

6. The process according to claim 3, wherein the increase in the portion of the feed introduced into the next guard zone downstream is from 0.02 to 1% per % of the deactivation time and/or clogging time.

7. The process according to claim 1, wherein a) and c) are carried out for a period between 30 and 95% of the deactivation time and/or clogging time of the first guard zone brought into contact with the feed.

8. The process according to claim 1, wherein a) and c) are carried out for a period between 60 and 90% of the deactivation time and/or clogging time of the first guard zone brought into contact with the feed.

9. The process according to claim 1, wherein said another portion of the feed introduced at the beginning of a') and c') into the next guard zone downstream of the first guard zone in the series of guard zones is from 0 to 50% of the total feed, expressed in vol. %.

10. The process according to claim 1, wherein said another portion of the feed introduced at the beginning of a') and c') into the next guard zone downstream of the first guard zone in the series of guard zones is from 20 to 40% of the total feed, expressed in vol. %.

11. The process according to claim 1, wherein the degree of hydrotreating is maintained by raising the temperature.

12. The process according to claim 1, wherein, at the entrance of each guard zone, the feed passes through a filtering distributor plate composed of a single stage or of two successive stages, said plate being situated upstream of the catalyst bed(s).

13. The process according to claim 1, wherein said process precedes a fixed bed or ebullating bed hydrotreating process.

* * * * *